United States Patent [19]

Omote et al.

[11] 4,236,274

[45] Dec. 2, 1980

[54] PANTOGRAPHIC OPEN-CLOSE DEVICE

[75] Inventors: Kazuaki Omote, Yokohama; Koji Watanabe, Niiza, both of Japan

[73] Assignees: Nissan Motor Company, Limited; Nifco Inc., both of Yokohama, Japan

[21] Appl. No.: 33,379

[22] Filed: Apr. 26, 1979

[30] Foreign Application Priority Data

Apr. 28, 1978 [JP] Japan ..... 53-56111[U]

[51] Int. Cl.[3] ..... E05D 7/00

[52] U.S. Cl. ..... 16/150

[58] Field of Search ..... 16/150, 190, 163, 191, 16/128; 220/31

[56] References Cited

U.S. PATENT DOCUMENTS

| | | | |
|---|---|---|---|
| 3,289,877 | 12/1966 | Wolf | 16/150 |
| 3,629,901 | 12/1966 | Wolf | 16/150 |
| 3,720,979 | 3/1973 | Krawagna | 16/150 |

FOREIGN PATENT DOCUMENTS 49-47567 of 1974 Japan .

52-77376 of 1977 Japan .

*Primary Examiner*—Doris L. Troutman

*Attorney, Agent, or Firm*—Trexler, Wolters, Bushnell & Fosse, Ltd.

[57] ABSTRACT

Two contraction-expansion pieces each have one end thereof connected to a base plate secured to a main body containing therein an opening and the other end thereof connected to a base plate secured to a lid serving to open and close the opening of the main body. The two contraction-expansion pieces which are each provided with a constricted, flexible elbow portion are pivotally fastened independently of each other and arranged in a mutually crossing state. Consequently, the two contraction-expansion pieces and the two base plates jointly form a pantographic mechanism. When the lid which is locked to the main body to keep the opening in its closed state while holding the pantographic mechanism in its folded state is released from the main body, the pantographic mechanism automatically expands and the lid is consequently brought to a completely opened state.

7 Claims, 16 Drawing Figures

PANTOGRAPHIC OPEN-CLOSE DEVICE

BACKGROUND OF THE INVENTION

This invention relates to an open-close device for disposal between a main body containing therein an opening and an open-close member capable of closing the aforementioned opening, for attaching the open-close member to the main body so as to be operable to open and close the opening.

As one typical example of prior art, there may be cited Japanese Utility Model Examined Publication No. 49(1974)/47567 which discloses a metallic open-close device formed of two pairs of movable members pantographically assembled by having one of the pairs of movable members pivotally fastened with pins at spaced locations to a first base plate secured to an inner surface of a main body, the other pair of movable members pivotally fastened with pins at spaced locations to a second base plate secured to a lid serving as an open-close member, the free ends of the movable members of one pair pivotally fastened with pins to the free ends of the corresponding movable members of the other pair, and the mutually crossing movable members, one from each of the two pairs, pivotally fastened to each other with a pin at the point of intersection thereof.

This metallic open-close device of the prior art is formed of two base plates and four movable members and assembled by use of seven pins. Since the number of component parts is very large, the work of assembling this device entails much time and labor. Further within this pantographic mechanism, there is separately incorporated a spring plunger unit which assumes the most compressed state at the medial length of its expansion or contraction and manifests its resiliency during its expansion or contraction past the aforementioned medial length. Thus, the spring plunger unit enables the device to produce a quickened motion during its operation.

An arrangement wherein the lid is normally locked in its closed state by means of a lock provided at the free end of the lid and, when necessary, the lid is automatically opened completely or partially by releasing the lock can not be accomplished with the aforementioned spring plunger unit. In any event, in the conventional pantographic open-close device, a movement making use of resiliency cannot be produced unless the device separately incorporates therein spring means. This inconvenience is similarly experienced by the open-close device disclosed in Japanese Utility Model Unexamined Publication No. 52(1977)/77376.

An object of this invention is to provide an open-close device which comprises only few parts molded of a plastic substance and, therefore, is capable of easy assemblage.

Another object of this invention is to provide a pantographic open-close device which is adapted so that an open-close member (the lid) is brought into its locked position to close the opening in the main body by contraction of the pantographic mechanism and the open-close member is brought into its completely or partially opened state by releasing the lock and consequently allowing the pantographic mechanism to expand automatically.

SUMMARY OF THE INVENTION

To accomplish the objects described above according to the present invention, there is provided a plastic pantographic open-close device which comprises first and second contraction-expansion pieces each formed of a pair of arms connected to each other through the medium of an elbow portion, two base plates one of which is secured to a main body containing an opening and the other of which is secured to an open-close member adapted to open and close the opening of the main body, one end of each contraction-expansion piece being connected to one of the base plates and the other end thereof being connected to the other base plate, the connection being an integral connection through an elbow portion either at both ends of one contraction-expansion piece and one end of the other contraction-expansion piece or at one end of each contraction-expansion piece and being through pivoted portions at the remaining ends of the contraction-expansion pieces, one of the arms of the first contraction-expansion piece and one of the arms of the second contraction-expansion piece being pivotally fastened and arranged in a crossing state, the first and second contraction-expansion pieces and the base plates jointly forming a pantographic mechanism, whereby the elbow portions accumulate therein, from the resiliency of the plastic material of which the device is made, a force to expand the pantographic mechanism large enough to overcome the total of frictional force generated by the pivoted portions when the pantographic mechanism is folded down to have the open-close member close the opening of the main body and the force thus accumulated serves the purpose of constantly keeping the pantographic mechanism energized in the direction of its expansion.

The open-close device of the present invention can be integrally molded of a plastic material. Thus, the device enjoys the advantage that it can be inexpensively produced and assembled in a short time with little labor. When the open-close member (lid) which is locked to the main body to keep the opening in its closed state while keeping the pantographic mechanism in its folded state is released from the main body, the pantographic mechanism is automatically expanded and the open-close member is consequently brought to a completely or partially opened state.

DESCRIPTION OF THE PREFERRED EMBODIMENT

Figure 1B:
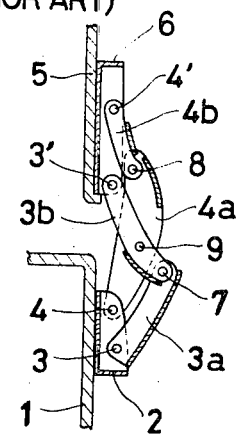
Fig. 1(B) (PRIOR ART)
FIG. 1(B) is a sectional view of the open-close device of FIG. 1(A) in its opened state.
Figure 1A:
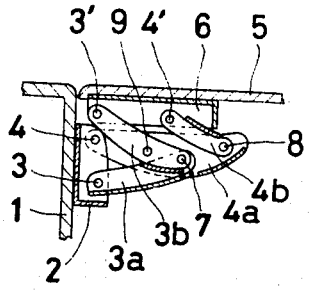
Fig. 1(A) (PRIOR ART)
FIG. 1(A) is a sectional view of a typical conventional open-close device in its closed state.

FIG. 1(A), FIG. 1(B) illustrates the metallic open-close device disclosed in Japanese Utility Model Examined Publication No. 49(1974)/47567. In the drawing, a pair of movable members 3*a*, 4*a* are pivotally fastened with pins 3, 4 at spaced locations to a first base plate 2 secured onto the inner surface of a main body 1, a pair of movable members 3*b*, 4*b* are pivotally fastened with pins 3', 4' at spaced locations to a second base plate 6 secured to a lid 5 serving as an open-close member, the free ends of movable members 3*a*, 3*b* are pivotally fastened to the corresponding free ends of movable members 4*a*, 4*b* with pins 7, 8 and the movable members 3*b*, 4*a* which cross each other are pivotally fastened with a pin 9 to each other at their intersection to form a pantographically assembled open-close device. This metallic open-close device of the prior art is formed of two base plates 2, 6 and four movable members 3*a*, 3*b*, 4*a* and 4*b* and assembled by use of seven pins 3, 3', 4, 4', 7, 8 and 9. Since the number of component parts is large, the work of assembling this device entails much time and labor. Further within this pantographic mechanism, there is separately incorporated a spring plunger unit which assumes the most compressed state at the medial length of its expansion or contraction and manifests its resiliency during its expansion or contraction past the aforementioned medial length. Thus, the spring plunger unit enables the device to produce a quickened motion during its operation. An arrangement wherein the lid is normally locked in its closed state by means of a lock provided at the free end of the lid and, when necessary, the lid is automatically opened completely or partially by releasing the lock can not be accomplished with the aforementioned spring plunger unit.

Now, the first embodiment of the open-close device of the present invention will be described with reference to FIGS. 2 to 7.

Referring to FIGS. 2 to 7, the open-close device 10 of the present invention possesses separately formed first and second contraction-expansion pieces 14, 18. The first contraction-expansion piece 14 is provided at one end thereof with a stationary base plate 19 secured immovably to the inner surface of the main body 1 and at the other end thereof with a movable base plate 20 secured to the inner surface of the open-close member 5 and, therefore, allowed to move simultaneously with the open-close member. The constricted portions of the two contraction-expansion pieces are molded of a suitable plastic substance such as a polypropylene resin which manifests proper resilience.

To be more specific, the open-close device of this invention possesses the first contraction-expansion piece 14 provided with a pair of arms 12, 13 connected to each other through an elbow portion 11 and the second contraction-expansion piece 18 provided with a pair of arms 16, 17 similarly connected to each other through an elbow portion 15. The stationary base plate 19 and the movable base plate 20 are connected to the opposite ends of the first contraction-expansion piece 14 respectively with elbow portions 19', 20'. The elbow portions 11, 15, 19' and 20' are all constructed in a constricted manner and, therefore, are flexible.

The arms 12, 13 of the first contraction-expansion piece 14 correspond to the movable members 3*a*, 3*b* of the conventional open-close device of FIG. 1 and the arms 16, 17 of the second contraction-expansion piece 18 similarly correspond to the movable members 4*a*, 4*b*. The elbow portions 11, 15 correspond to the pins 7, 8 and the elbow portions 19', 20' similarly correspond to the pins 3, 3'. As a result, the four pins 3, 3', 7 and 8 used in the conventional device are eliminated in the device of the present invention. Where the conventional device necessitates use of six component parts, namely two base plates 2, 6 and four movable members 3*a*, 3*b*, 4*a* and 4*b*, only two plastic molded pieces, namely the first and second contraction-expansion pieces, will do in the present embodiment.

Figure 4:
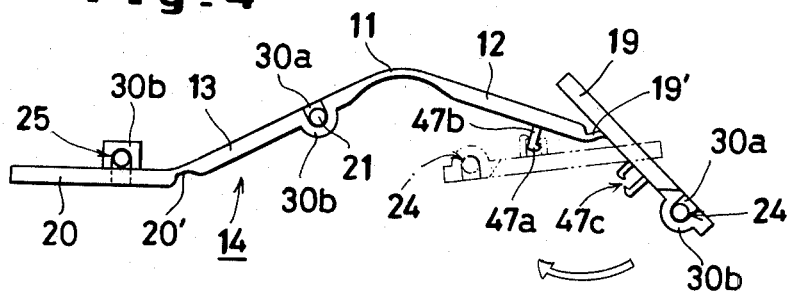
FIG. 4 is a side view of one of the contraction-expansion pieces in the open-close device of FIG. 2.
Figure 5:
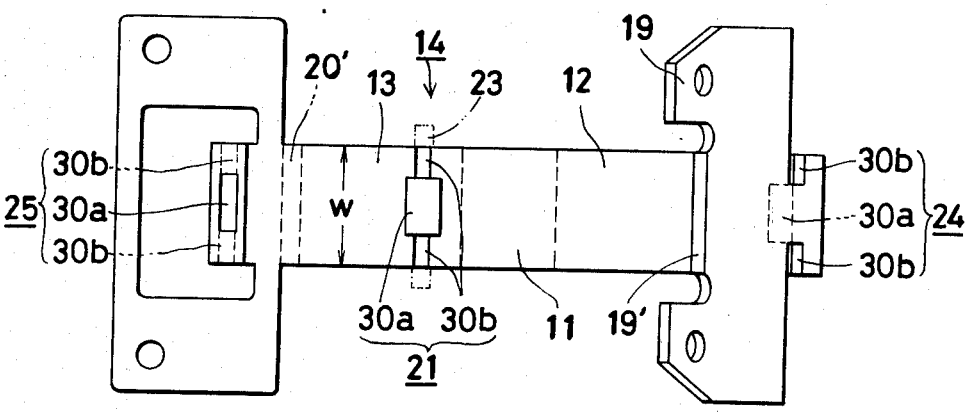
FIG. 5 is a plan view of the contraction-expansion piece of FIG. 4.
Figure 6:
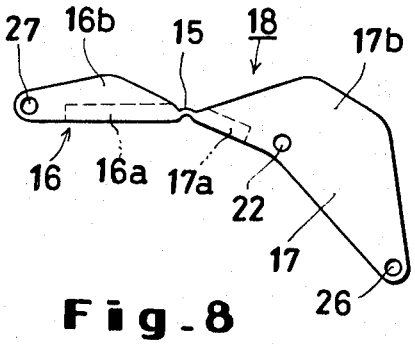
FIG. 6 is a side view of the other contraction-expansion piece of the open-close device of FIG. 2.
Figure 7:
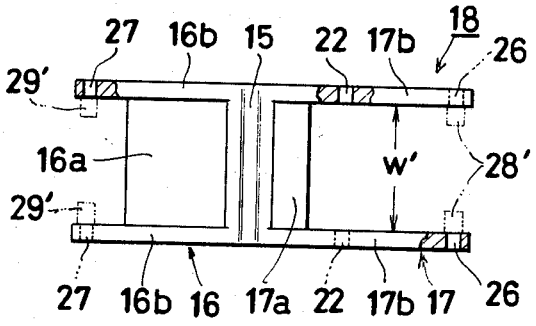
FIG. 7 is a plan view of the contraction-expansion piece of FIG. 6.

The arms 12, 13 of the first contraction-expansion piece 14 are plate-shaped. For the arm 13 and the arm 17 of the second contraction-expansion piece to be pivotally fastened to each other in a mutually intersecting state, the arm 13 is provided midway of the length thereof with a lateral hole 21 for passing a pin (FIGS. 4 and 5). The arm 17 of the second contraction-expansion piece 18 comprises a plate piece 17*a* continuing at one end thereof into the elbow portion 15 and beams 17*b* contiguous with the opposite lateral edges of the plate piece 17*a*. The beams 17*b* are spaced at an interval W' greater than the width W of the arm 13 and protrude considerably past the other end of the plate piece 17*a* (FIGS. 6 and 7). The beams 17*b* have holes 22 at positions close to the end of the plate piece 17*a* furthest from the elbow portion 15. The pivotal fastening of the arms 13, 17, therefore, is accomplished by having the arm 13 inserted in a crossing state in the internal W' of the opposite beams 17*b*, causing the holes 21, 22 to coincide with one another and passing a pin 23 through the coinciding holes.

The stationary base plate 19 and the movable base plate 20 have insertion holes 24, 25 formed parallelly to the hole 21 at locations separated from the elbow portions 19', 20'. In order that the leading end of the arm 17 of the second contraction-expansion piece 18 may be pivotally fastened to the stationary base plate 19 through the medium of pin 28 and insertion hole 24, the beams 17*b* are provided at their leading ends with holes 26. The other arm 16 of the second contraction-expansion piece, similarly to the arm 17, is provided with a plate piece 16*a* continuing at one end thereof into the elbow portion 15 and beams 16*b* contiguous with the opposite lateral edges of the plate piece 16*a* and slightly protruding from the other end of the plate piece 16*a*. The beams 16*b* are provided at their leading ends with holes 27. Through the medium of pin 29 and insertion hole 25, these beams are pivotally fastened with the movable base plate 20.

Consequently, the extremities of the arms 16, 17 of the second contraction-expansion piece 18 can be pivotally fastened to the base plates 19, 20 respectively by bending the two contraction-expansion pieces at the elbow portions 11, 15, folding the two base plates 19, 20 at the elbow portions 19', 20' relative to the arms 12, 13, passing a pin 28 through the holes 26 at the leading ends of the arm 17 and the insertion hole 24 of the stationary base plate 19 and further passing a pin 29 through the holes 27 at the leading end of the arm 16 and the insertion hole 25 of the movable base plate 20. Thus, the two contraction-expansion pieces 14, 18 are assembled by use of three pins 23, 28 and 29 into a pantographic open-close device 10.

Figure 8:
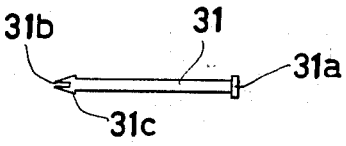
FIG. 8 is a side view of one example of the pins used for pivotally fastening the contraction-expansion pieces.

In the present embodiment, the insertion holes 21, 24 and 25 provided in the plate-shaped arm 13 have a common construction which comprises a central groove **30*a* having a cross section conforming to one half of the circle of a pin and two distal grooves 30*b* having a cross section conforming to the other half of the circle of the pin and disposed to adjoin the central groove 30*a* at the opposite ends thereof, with the central groove 30*a* formed in one surface of the plate and the distal grooves 30*b* formed in the other surface of the plate. This specific formation of grooves is purely for convenience in molding. The grooves, therefore, need not be limited to this specific pattern. The pins 23, 28 and 29 used for the insertion holes 21, 24 and 25 may be metallic cotter pins or other similar pins. For example, as shown in FIG. 8, pins each comprising a shank 31, a head portion 31*a* formed at one end of the shank and a conically expanded portion 31*c* formed at the other end of the shank and adapted to be radially contracted by virtue of a slit 31*b* may be obtained by injection molding a plastic substance. These plastic pins are passed through the insertion holes and the holes, i.e. 21 and 22, 24 and 26, and 25 and 27, with the conically expanded portions 31*c* contracted radially and the conically expanded portions 31*c* upon emergence from the holes, and are allowed to resume their original state and consequently remain irremovably in the holes. Either the insertion holes 21, 24 and 25 or the holes 22, 26 and 27 may be replaced with integrally molded pin-shaped projections 23', 28' and 29' as shown in FIG. 5 and FIG. 7** and these projections may be inserted into the corresponding insertion holes or holes to effect the pivotal fastening. This arrangement offers the advantage of even obviating the necessity for using three pins for the pivotal fastening.

Figure 2:
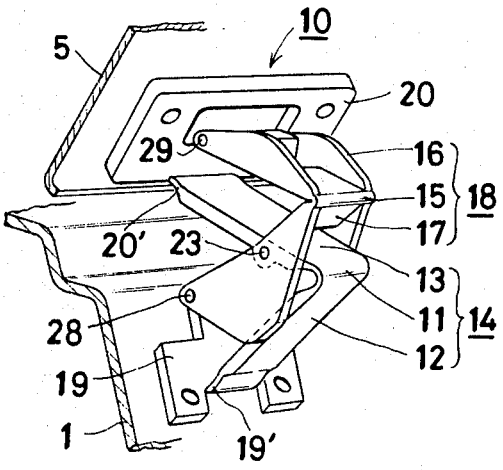
FIG. 2 is a perspective view of one embodiment of the open-close device of the present invention in its partially opened state.
Figure 3B:
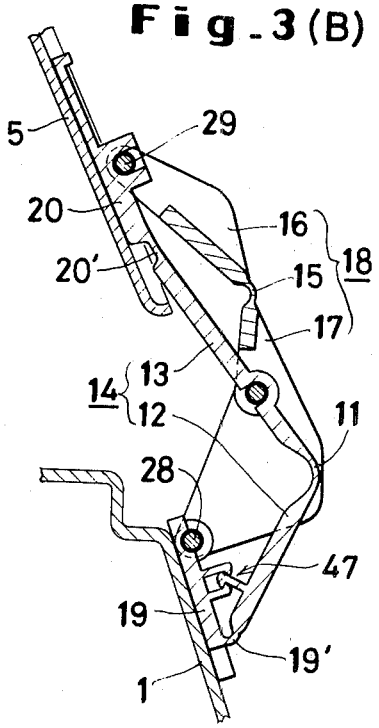
FIG. 3(B) is a sectional view of the same device in its opened state.
Figure 3A:
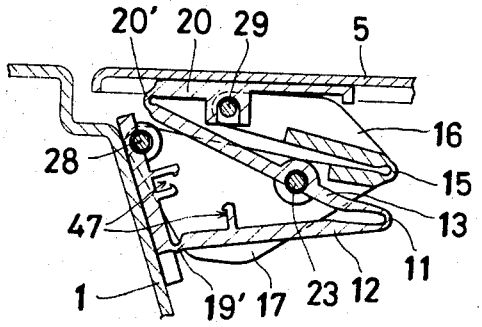
FIG. 3(A) is a sectional view of the open-close device of FIG. 2 in its closed state.

In the open-close device 10 of the construction described above, the stationary base plate 19 is secured to the inner surface of the wall of the main body 1 which bends down from the edge of the opening and the movable base plate 20 is secured to the inner surface of the hinged side of the open-close member 5 such as a lid capable of closing the aforementioned opening (FIG. 2). When the lid is in its opened state, the pantographic mechanism of the device is expanded, the base plates 19, 20 run substantially parallelly to each other and the elbow portions 11, 15 are stretched out (FIG. 3(B)). When the lid is closed with the free end of the open-close member locked to the main body 1, the elbow portions 11, 15 are bent largely and the two contraction-expansion pieces 14, 18 are respectively folded back. Consequently, the pantographic mechanism is collapsed to bring the movable base plate 20 to a position substantially perpendicular to the stationary base plate 19, and the elbow portions, particularly 11, 15, acquire force tending to elongate the pantographic mechanism (FIG. 3(A)). When the free end of the open-close member is unlocked from the main body, the force built up in the elbow portions causes the contraction-expansion pieces 14, 18 to stretch out to expand the pantographic mechanism and automatically cause the open-close member to open completely or partially.

In any event, when the pantographic mechanism is folded down to bring the open-close member into its locked position, the elbow portions, owing to the resilient property of the plastic substance of which the elbow portions are made, store energy therein capable of expanding the pantographic mechanism by overcoming the total sum of the frictional forces of the pins 23, 28 and 29 or the pin-shaped projections 23', 28' and 29' at the pivotally fastened portions. The resiliently stored energy energizes the pantographic mechanism in the direction of its expansion. In the present embodiment, the accumulation of this energy occurs preponderantly in the elbow portions 11, 15. The elbow portions 11, 15 are so constructed that the sum of the energy accumulated therein will be greater than the total of frictional forces at the pivotally fastened portions. In this respect, the elbow portion 20' plays an auxiliary part. As occasion demands, the elbow portions may be constructed so that the total of energy accumulated in three elbow portions 11, 15 and 20' is barely enough to overcome the total frictional force of the pivotally fastened portions or the energy accumulated in any one of the three elbow portions exceeds the total frictional force of the pivotally fastened portions. If the extent to which the pantographic mechanism is expanded by the resiliently stored energy in the elbow portions is not sufficient for the purpose of separating the open-close member from the opening, a spring (not shown) adapted to be contracted under the force generated by the folding of the pantographic mechanism may be provided between the arms 12, 13 of the first contraction-expansion piece 14, so that the spring will exert the force required for opening the open-close member.

The embodiment so far described has a construction wherein the stationary base plate 19 and the movable base plate 20 are connected to the opposite ends of the first contraction-expansion piece 14. For this reason, the stationary base plate 19 is folded backward at the elbow portion 19' relative to the arm so that the insertion hole 24 is positioned below the arm 12 and, through the medium of this insertion hole 24, the stationary base plate 19 may be pivotally fastened with the corresponding end of the arm 17 of the second contraction-expansion piece, giving rise to the pantographic mechanism.

Figure 9:
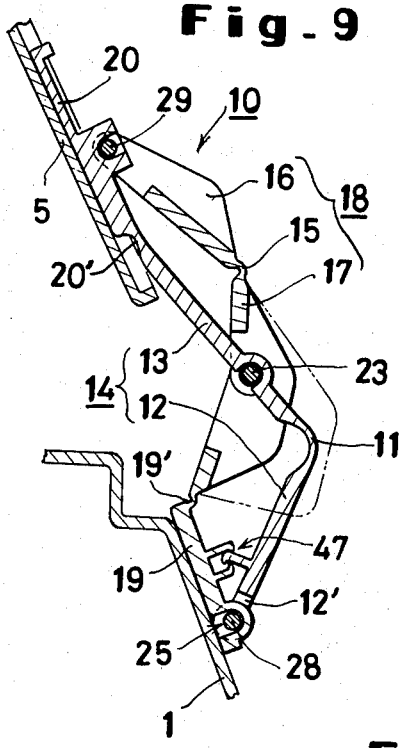
FIG. 9 is a sectional view of another embodiment of the open-close device of the present invention in its opened state.

Alternatively, the stationary base plate 19, for example, may be connected through the medium of the elbow portion 19' to the end of the arm 17 of the second contraction-expansion piece so that the first contraction-expansion piece 14 will be provided with the movable base plate 20 and the second contraction-expansion piece 18 with the stationary base plate 19. The embodiment of FIG. 9 illustrates this modification. In this case, the stationary base plate 19 is connected through the medium of the elbow portion 19' to the end of the arm 17 in such a manner that it will extend forward from the aforementioned end. This base plate 19 is provided at the leading portion thereof with an insertion hole 25. In the first contraction-expansion piece, the arm 12 is provided at the opposite lateral sides with projections 12' protruding from the end portion of the arm, so that the desired pivotal fastening may be accomplished by means of the projections 12' and the insertion hole 25 and pin 28 mentioned above. Since the rest of the construction is similar to the construction of the preceding embodiment, like parts are designated by like symbols and the description thereof is omitted to avoid repetition.

Figure 11:
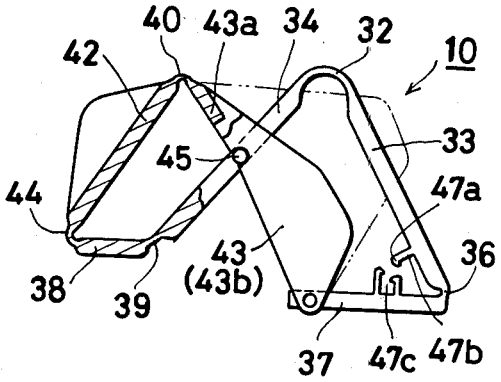
FIG. 11 is a partial sectional side view of the open-close device of FIG. 10 in an assembled state with the pantographic mechanism in the expanded position.
Figure 10:
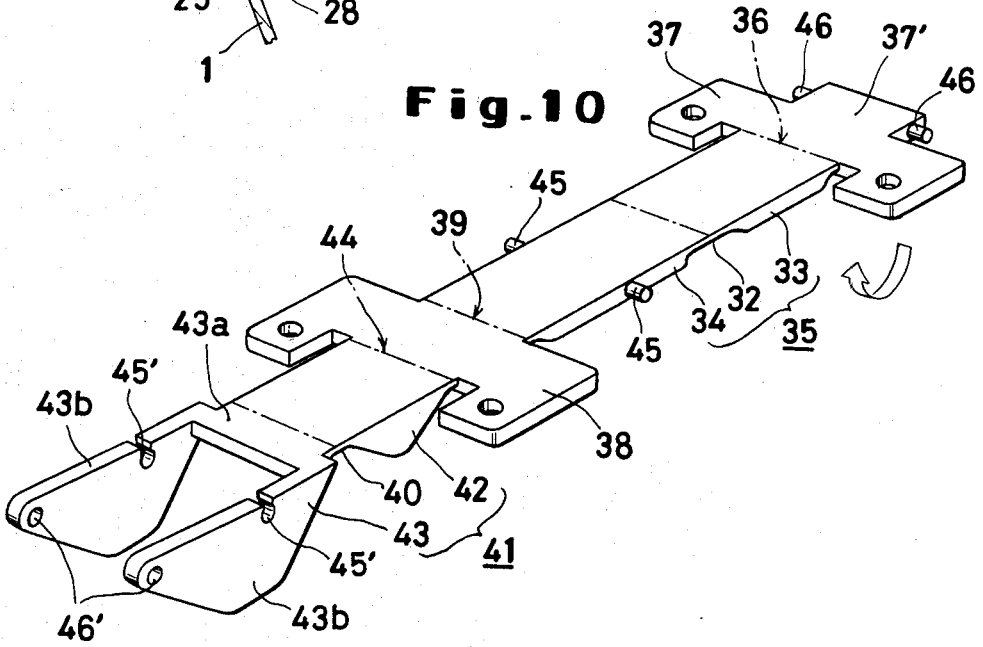
FIG. 10 is a perspective view of still another embodiment of the open-close device of this invention in an unassembled state.

The two embodiments described above share a common principle that the first contraction-expansion piece 14 and the second contraction-expansion piece 18 are separately molded of a plastic substance and they are assembled by pivotally fastening their relevant parts at three points. The present invention, however, can be accomplished otherwise by having the two contraction-expansion pieces integrally molded as illustrated in FIGS. 10 and 11. Specifically in this case, the first contraction-expansion piece 35 which comprises a pair of arms 33, 34 connected to each other through the medium of an elbow portion 32 has a base plate 37 connected to the arm 33 through a flexible elbow portion 36, so that the first contraction-expansion piece 35 may be bent at the elbow portion 32 so as to assume the shape of a hill and, at the same time, the base plate 37 is bent at the elbow portion 36 relative to the arm 33. The other base plate 38 is connected through an elbow portion 39 to the end of the other arm 34. To the leading end of the base plate 38, one of the pair of arms 42, 43 of the second contraction-expansion piece 41 which are connected to each other through the medium of an elbow portion 40 is connected through an elbow portion 44. In this case, the other arm 43 which is not connected to the base plate 38 is formed of a plate piece 43*a* having one end thereof constituting the elbow portion 40 and beams 43*b*, 43*b* rising from the opposite lateral edges of the plate piece 43*a* with an interval greater than the width of the arm 34 and protruding far past the other end of the plate piece 43*a*. Consequently, the arm 42 is bent at the elbow portion 44 relative to the base plate 38 and, at the same time, the second contraction-expansion piece 41 which comprises the arms 42, 43 is bent in the shape of a hill at the elbow portion 40, the arm 34 of the first contraction-expansion piece is inserted in an intersecting manner in the space between the beams 43*b* and the arm 34 is pivotally fastened with the arm 43 and the end of the arm 43 similarly fastened with the base plate 37 respectively (FIG. 11). In the present embodiment, therefore, the pantographic open-close device is assembled simply by effecting the pivotal fastening at two points in one molded plastic piece integrally containing two contraction-expansion pieces 35, 41 and two base plates 37, 38. Thus, the assemblage of device is accomplished more simply in the present embodiment than in the aforementioned two embodiments. Of course, also in the present embodiment, the open-close device 10 is adapted so that the total force tending to cause expansion of the pantographic mechanism which the elbow portions 32, 39 and 40 accumulate therein while the pantographic mechanism is kept in its folded state is greater than the total of the frictional force generated at the two pivotally fastened portions and the resilient force generated at the elbow portions 36, 44. Consequently, the open-close device is energized in the direction of its expansion.

The pivotal fastening can be obtained by use of pins. In the present embodiment, two pairs of pin-shaped projections 45, 46 integrally formed on the opposite lateral sides respectively of the arm 34 and the tail portion 37' which protrudes backwardly from the end of the base plate 37 and matching holes 45', 46' are formed roughly in the middle and at the end respectively of the arm 43, so that the projections 45, 46 will be inserted respectively into the holes 45', 46'. Thus, the one molded plastic piece can be assembled into the pantographic open-close device all by itself.

Figure 12:
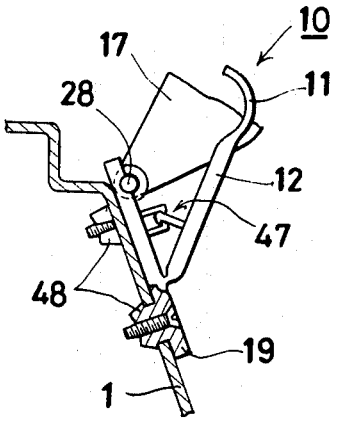
FIG. 12 is a partial sectional side view of yet another embodiment of the open-close device of the present invention.

Any of the embodiments described so far may be additionally provided with engaging means 47 capable of retaining the open-close member 5 (the lid) of the device in its opened state after the pantographic mechanism has been expanded to separate the open-close member from the opening in the main body 1. This engaging means 47 locks the open-close device in its opened state and prevents it from unexpectedly closing the opening. This engaging means is illustrated as comprising a protuberating ridge 47*b* possessed of a head 47*a* and a groove 47*c* capable of resiliently admitting the head 47*a*, the ridge 47*b* and the groove 47*c* on the opposed surfaces of the parts adapted to approach each other when the pantographic mechanism is being expanded, namely the arm 12 and the base 19 in the case of the embodiments of FIGS. 2 to 7 and FIG. 9 or the arm 33 and the base plate 37 in the case of the embodiment of FIGS. 10 and 11. This engaging means 47 is so adapted that when the open-close member in its opened state is closed by exertion of slight force, the head 47*a* of the protuberating ridge 47*b* forces its way out of the groove 47*c*. Of course, the engaging means is not limited to this particular arrangement. Further, owing to the fact that the base plates 19, 20 or 37, 38 are molded of a plastic substance, they can be integrally provided with studs 48 useful for the purpose of attachment of the open-close device to the main body and the open-close member (FIG. 12).

These studs 48 may be formed each in the well-known shape of an anchor which is passed in its contracted state through the matching hole bored in the main body or the open-close member and, after passage of the hole, allowed to resume its original shape owing to the resiliency and consequently remain fast in position behind the rear edge of the hole or in the known shape of a screw socket which is passed through the matching hole and, after passage of the hole, is expanded radially by insertion therein of a screw. Where the main body and the open-close member are allowed to be made of the same plastic substance as the base plates, such base plates can be molded as the main body and the open-close member. When the movable base plate 20 or 38 is molded as an open-close member, for example, the work of securing the base plate 20 or 38 to a separately molded open-close member. Since the open-close member which would otherwise be made of a metallic material is formed of a plastic substance in this case, it enjoys reduction of weight and protection against rusting.

Figure 13:
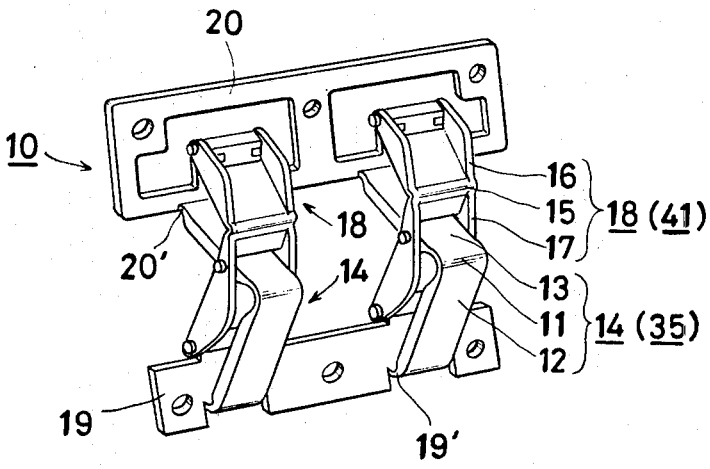
FIG. 13 is a perspective view of a further embodiment of the open-close device having a plurality of contraction-expansion pieces disposed serially relative to a base plate.

Further as illustrated in FIG. 13, a plurality of contraction-expansion pieces 14 (35), 18 (41) can be serially disposed for each pair of base plates 19, 20 or 37, 38.

In the embodiment of FIGS. 2 to 7, the beams 17*b* of the arm 17 pivotally fastened in a state to cross the arm 13 continues to embrace within the space W' thereof the arm 12 connected to the arm 13 even after the pantographic mechanism has been expanded. In the embodiments of FIG. 9 and FIGS. 10 and 11, when the beams 17*b*, 43*b* of the arms are adapted so that they continue to embrace in the space W' thereof the arms 12, 33 not only when the pantographic mechanism is folded as shown by the dotted line but also when it is expanded, the open-close devices acquire enough strength to resist possible twisting.

In all the embodiments given above, the elbow portions have been described as possessing a constricted flexible structure. Alternatively, some of the elbow portions may be formed in the shape of male-female hinges which offer higher rigidity and the remaining elbow portions may be adapted to energize the pantographic mechanism in the direction of expansion.

Figure 14:
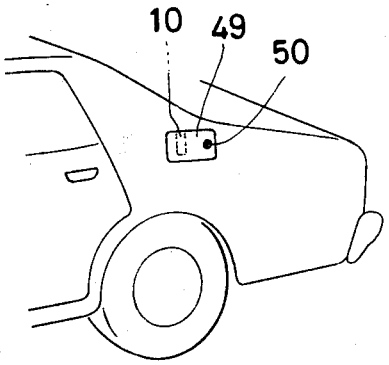
FIG. 14 is an explanatory view showing the open-close device of this invention in a state actually used in an automobile.

The open-close device 10 of the present invention, for example, may be disposed between a lid 49 serving to close a recess in an automobile body where there is disposed a gasoline inlet and the portion of automobile body adjoining the recess (FIG. 14). Normally, the lid 49 is retained in its closed state by the lock 50. As soon as the lock is released, the lid 49 automatically opens completely or partially. Thus, this arrangement offers great ease of operation and fulfills its purpose advantageously.

What is claimed is:

1. A plastic pantographic open-close device, comprising a first contraction-expansion piece formed of a pair of arms connected to each other through the medium of an elbow portion, a second contraction-expansion piece formed of a pair of arms connected to each other through the medium of an elbow portion, one of the arms of the first contraction-expansion piece and one of the arms of the second contraction-expansion piece pivotally fastened independently of each other and arranged in a crossing state, a first base plate secured to a main body containing an opening and connected one of the arms of the first contraction-expansion piece and one of the arms of the second contraction-expansion piece through the medium of respective connection means, a second base plate secured to an open-close member serving to open and close the opening of the main body and connected to the other arm of the first contraction-expansion piece and the other arm of the second contraction-expansion piece through the medium of respective connection means, the first contraction-expansion piece, the second contraction-expansion piece, the first base plate, the second base plate and their respective connection means jointly forming a pantographic mechanism, whereby the elbow portions and the connection means accumulate, from the resiliency of the plastic material of which the device is made, a force capable of expanding the pantographic mechanism notwithstanding the total of frictional force generated by the pivotally fastened portions when the pantographic mechanism is folded down to have the open-close member close the opening of the main body and the force thus accumulated serves to energize the pantographic mechanism in the direction of expansion when the open-close member is separated from the opening of the main body.

2. The pantographic open-close device according to claim 1, wherein the first and second contraction-expansion pieces are formed of a plastic substance separately of each other.

3. The pantographic open-close device according to claim 1, wherein the first and second contraction-expansion pieces are integrally formed of a plastic substance.

4. The pantographic open-close device according to claim 1, further comprising an engaging means provided between at least one base plate and the arm of the first contraction-expansion piece to which the base plate is connected through the medium of the connection means, for retaining the pantographic mechanism in its expanded state.

5. The pantographic open-close device according to claim 1, wherein the base plates and the arms of the contraction-expansion pieces are connected through respective connection means which are in the form of elbow portions.

6. The pantographic open-close device according to claim 1, wherein the connection of the base plates to the arms of the contraction-expansion pieces is accomplished by pivotally fastening the end portions of the arms to the base plates.

7. The pantographic open-close device according to claim 1, wherein the second base plate is an open-close member serving to open and close the opening of the main body.

* * * * *